US005767468A

United States Patent [19]

Tsai

[11] Patent Number: 5,767,468

[45] Date of Patent: Jun. 16, 1998

[54] KEY SWITCH ASEMBLY FOR A COMPUTER KEYBOARD

[76] Inventor: Huo-Lu Tsai, No. 126-1, Shui-Nan Rd., Taichung City, Taiwan

[21] Appl. No.: 853,748

[22] Filed: May 9, 1997

Related U.S. Application Data

[63] Continuation-in-part of Ser. No. 684,478, Jul. 19, 1996, abandoned.

[51] Int. Cl.[6] ..... H01H 3/12

[52] U.S. Cl. ..... 200/344

[58] Field of Search ..... 200/344, 517; 400/491.2, 495, 490; 341/22; 361/680

[56] References Cited

U.S. PATENT DOCUMENTS 4,902,862 2/1990 Oelsch et al. ..... 200/344
5,278,374 1/1994 Takagi et al. ..... 200/344 X
5,382,762 1/1995 Mochizuki ..... 200/344 X
5,457,297 10/1995 Chen ..... 200/344
5,590,020 12/1996 Sellers ..... 200/344 X

*Primary Examiner*—Renee S. Luebke
*Attorney, Agent, or Firm*—Oblon, Spivak, McClelland, Maier & Neustadt, P.C.

[57] ABSTRACT

A key switch assembly for a computer keyboard includes a base board, a membrane circuit disposed on the base board, a biasing member supported on the membrane circuit, a key cap support, and a key cap. The key cap support is disposed between the base plate and the key cap. The base plate has a key confining frame portion with an opening for receiving the lower portion of the biasing member, and opposite first and second hole defining portions which define two opposite sides of the opening. The first and second hole defining portions have top surfaces flush with the top surface of the frame portion, and indented bottom surfaces that confine outwardly extending retaining strips of the biasing member therein such that the biasing member is prevented from lateral movement, thereby securing the biasing member between the base plate and the key cap.

14 Claims, 3 Drawing Sheets

KEY SWITCH ASEMBLY FOR A COMPUTER KEYBOARD

CROSS-REFERENCE OF RELATED APPLICATION

This application is a Continuation-in-Part (CIP) of U.S. patent application Ser. No. 08/684,478, filed on Jul. 19, 1996 and abandoned as of the filing date of this application.

BACKGROUND OF THE INVENTION

1. Field of the Invention

The invention relates to a key switch assembly, more particularly to a key switch assembly for a computer keyboard and the like.

2. Description of the Related Art

U.S. Pat. Nos. 5,457,297 and 5,278,374 respectively disclose key switch assemblies for a computer keyboard. The key switch assemblies include a base board, a membrane circuit, an upright biasing member, a base plate, a scissors-type key cap support, and a key cap. The membrane circuit is disposed on the base board and has an electrical contact. The biasing member is disposed on the membrane circuit. The base plate is disposed on the membrane circuit and is formed with a through opening to permit extension of the biasing member therethrough. The opening of the base plate has opposite first and second sides. The base plate is further formed with a first slot retainer unit adjacent to the first side of the opening and a first pivot retainer unit adjacent to the second side of the opening. The key cap support is disposed on the base plate and includes first and second support levers with upper and lower portions, and intermediate portions that are coupled rotatably about a pivot axis. The lower portion of the first support lever is slidably retained in the first slot retainer unit of the base plate. The lower portion of the second support lever is pivotally retained in the first pivot retainer unit of the base plate. The key cap has a bottom side formed with a second slot retainer unit for slidably retaining the upper portion of the second support lever, and a second pivot retainer unit for pivotally retaining the upper portion of the first support lever. The key cap is biased upwardly by the biasing member and is depressible to compress the biasing member which consequently contacts the electrical contact of the membrane circuit to produce an electrical signal.

Some disadvantages of the aforementioned key switch assemblies are as follows:

(I) The base plate in the key switch assembly of U.S. Pat. No. 5,457,297 has opposite upright projections that project relative to the upper surface thereof for formation of the slot retainer unit and the pivot retainer unit so as to retain slidably and pivotally the lower portions of the first and second support levers. Thus, the plunger of the key cap must be made longer to prevent the upright projections from hindering downward movement of the key cap prior to the generation of the electrical signal during a key depression operation, thereby resulting in a larger key switch assembly.

(II) The base plate in the key switch assembly of U.S. Pat. No. 5,278,374 is provided with downward open round recesses and downward open elongated recesses at two opposite sides of the opening for slidably and pivotally retaining the lower portions of the first and second support levers. As such, prior to the mounting of the base plate on the membrane circuit, the upper portions of the first and second support levers of the key cap support have to be inserted through the opening of the base plate from the bottom of the latter. Only then can the lower portions of the first and second support levers be mounted slidably and pivotally in the downward open round and elongated recesses of the base plate. Therefore, the biasing member and the membrane circuit are secured on the base plate while the latter remains upturned. The base plate is then inverted for securing the key cap on the first and second support levers. The mounting process is, therefore, relatively complicated and consequently results in long assembly time and extra manufacture expenses.

SUMMARY OF THE INVENTION

The object of this invention is to provide a key switch assembly for a computer keyboard which permits further reduction in its thickness and which is convenient to manufacture.

Accordingly, the key switch assembly for a computer keyboard of this invention includes a base board, a membrane circuit, an upright biasing member, a base plate, a scissors-type key cap support, and a key cap. The structures of the base board, the membrane circuit, the key cap support and the key cap are generally similar to those described in the aforesaid U.S. Patents.

The improvements of this invention reside in the base plate and the biasing member of the key switch assembly. The biasing member has a lower portion formed with a pair of outwardly extending retaining strips. Each of the retaining strips has a bottom surface. The base plate includes a rectangular key confining frame portion that is formed with an opening and that has a top surface, and opposite first and second hole defining portions that extend inwardly from the frame portion and that have two terminating edges to confine two opposite sides of the opening. The first and second hole defining portions have bottom surfaces, and top surfaces generally flush with the top surface of the frame portion. A third hole defining portion extends inwardly from the frame portion in a direction transverse to the first and second hole defining portions, and has a bottom surface which projects with respect to the bottom surfaces of the first and second hole defining portions. The retaining strips of the biasing member are disposed beneath the bottom surfaces of the first and second hole defining portions such that the bottom surfaces of the retaining strips are substantially flush with the bottom surface of the third hole defining portion and such that the retaining strips are prevented from lateral movement by the third hole defining portion, thereby securing the biasing member between the base plate and the membrane circuit.

The base plate has two opposite flange units which extend inwardly from the frame portion toward two opposite longitudinal edges of the first hole defining portion. Thus, two L-shaped slots are formed at the opposite longitudinal edges of the first hole defining portion so as to constitute two slot retainer units. The flange units have top surfaces which are substantially flush with the top surface of the frame portion, and bottom surfaces which are indented with respect to the bottom surface of the third hole defining portion. The flange units further have end portions that terminate adjacent to the terminating edges of the first hole defining portion and that are formed with a respective downward stops, thereby forming slide recesses in the bottom surfaces of the flange units. Two outward pins on the lower portion of the first support lever are inserted through the L-shaped slots and are slidably retained in the slide recesses. Preferably, the outward pins on the lower portion of the first support lever are in direct sliding contact with the membrane circuit.

The base plate is further provided with two opposite cantilevers that extend inwardly from the frame portion toward two opposite longitudinal edges of the second hole defining portion. Each of the cantilevers has one side formed with a first barb projection, and a top surface substantially flush with the top surface of the frame portion. Opposite second barb projections are formed on the longitudinal edges of the second hole defining portion and are aligned spacedly and respectively with the first barb projections. The first and second barb projections cooperatively constitute the pivot retainer units. Two outward pins on the lower portion of the second support levers can be forced between aligned ones of the first and second barb projections. Preferably, the outward pins on the lower portions of the second support lever are in direct sliding contact with the membrane circuit.

Because the outward pins on the first and second support levers are disposed underneath of the base plate, the total thickness of the key switch assembly can be reduced. In addition, the sliding and pivotal contact of the outward pins on the membrane circuit produce little friction.

BRIEF DESCRIPTION OF THE DRAWINGS

Other features and advantages of this invention will become apparent in the following detailed description of the preferred embodiment of this invention, with reference to the accompanying drawings, in which.

DETAILED DESCRIPTION OF THE PREFERRED EMBODIMENT

Figure 1:
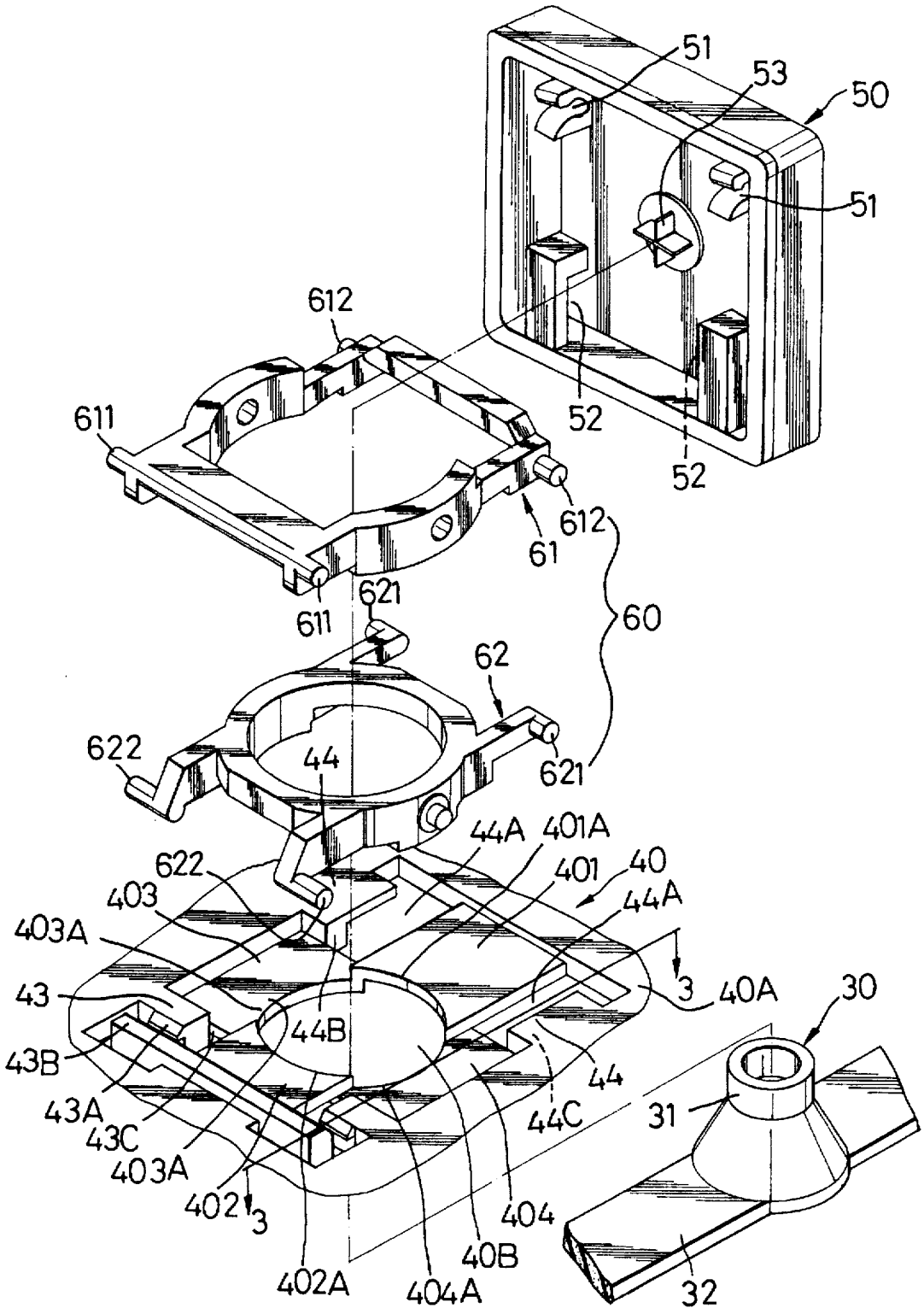
FIG. 1 is an exploded view of a preferred embodiment of a key switch assembly for a computer keyboard according to this invention.
Figure 2:
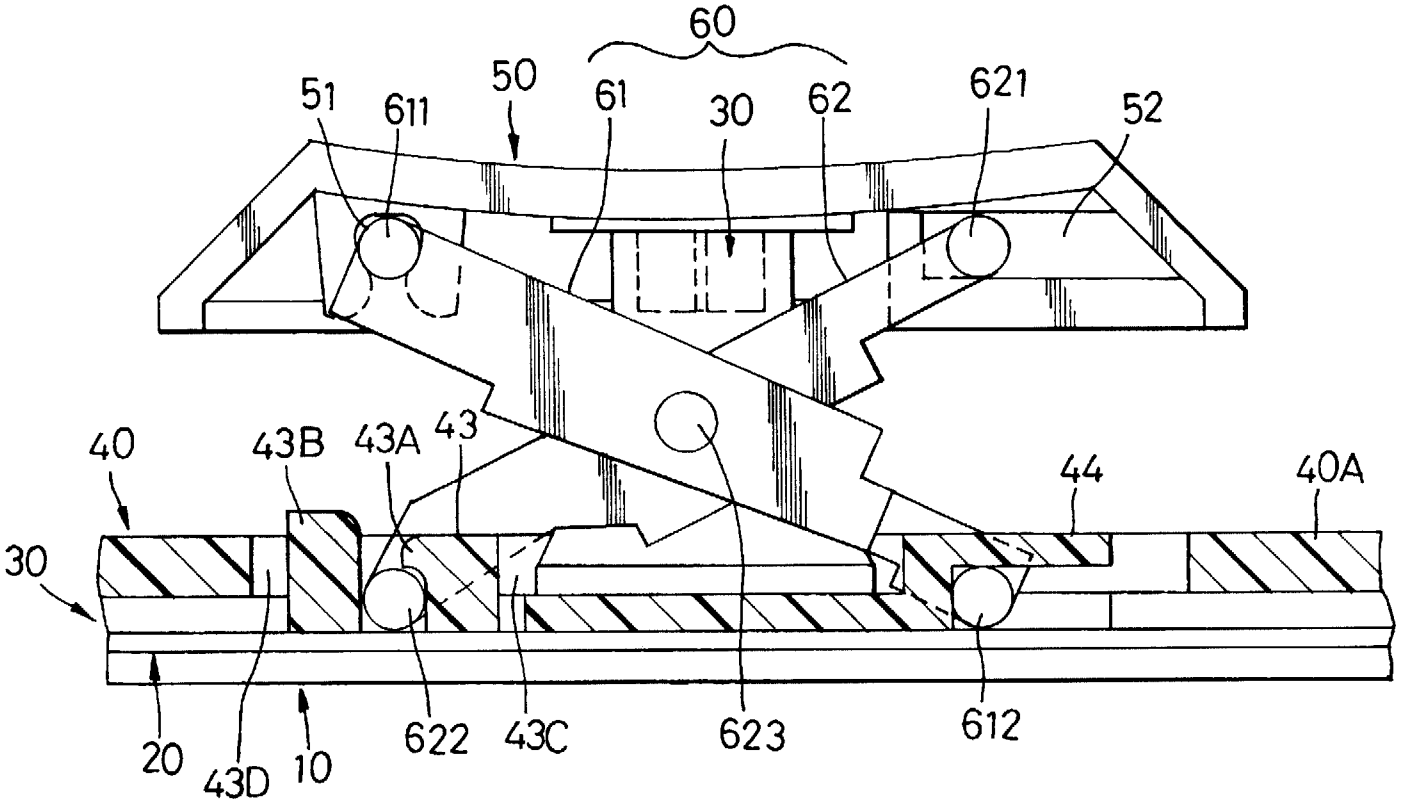
FIG. 2 is a partly sectional view of the preferred embodiment, illustrating the key switch assembly at a non-depressed position.
Figure 3:
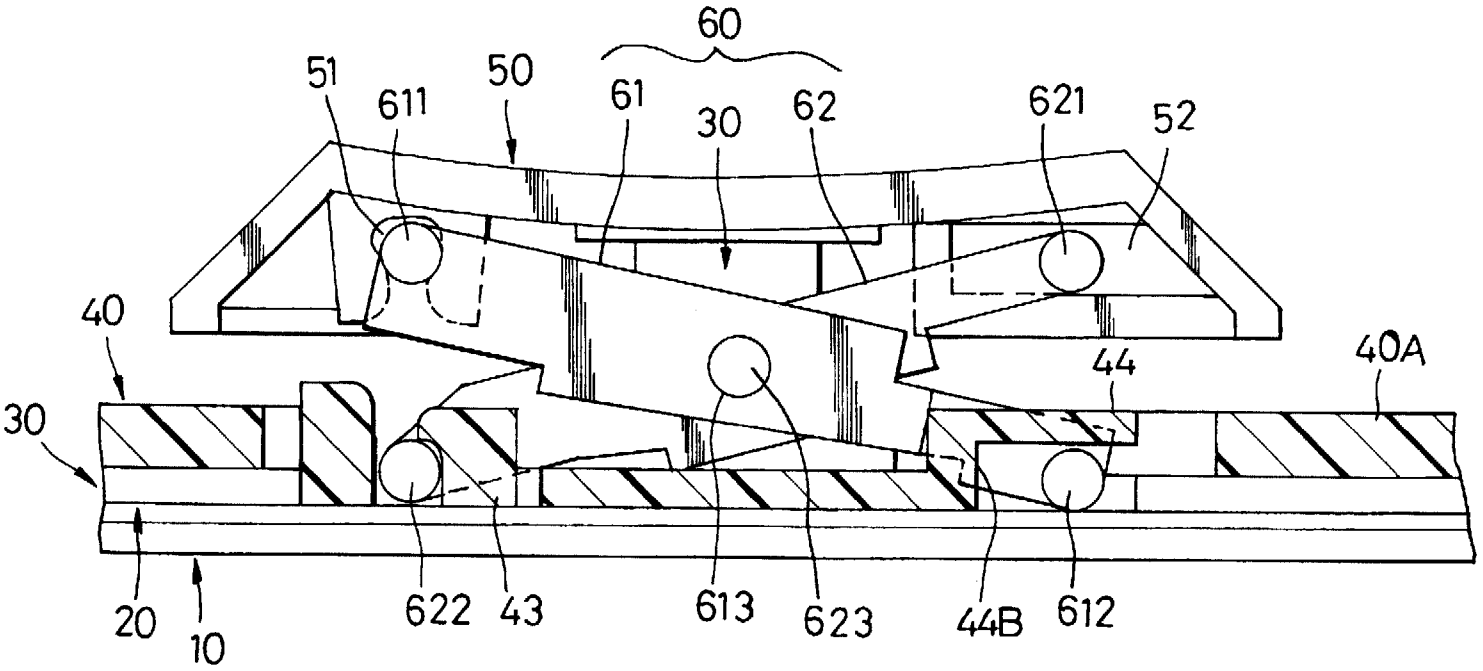
FIG. 3 is a partly sectional view of the preferred embodiment, illustrating the key switch assembly at a depressed position.

Referring to FIGS. 1, 2 and 3, the preferred embodiment of a key switch assembly for a computer keyboard of this invention includes a base board 10, a membrane circuit 20, an upright biasing member 30, a base plate 40, a scissors-type key cap support 60, and a key cap 50.

The membrane circuit 20 is conventional in construction and is disposed on the base board 10. The membrane circuit 20 includes superimposed first and second printed circuit layers (not shown) and a perforated spacer (not shown) between the first and second printed circuit layers.

The biasing member 30 is disposed on the membrane circuit 20 and has an upper portion 31 and a lower portion formed with a pair of outwardly extending retaining strips 32.

The base plate 40 is disposed on the membrane circuit 30 and includes a rectangular key confining frame portion 40A with a top surface and an opening 40B to permit extension of the upper portion 31 of the biasing member 30 therethrough. The base plate 40 further includes aligned first and second hole defining portions 401, 402 which extend inwardly from the frame portion 40A, and aligned third and fourth hole defining portions 403, 404 which extend inwardly from the frame portion 40A in a direction transverse to the first and second hole defining portions 401, 402. The terminating edges 401A, 402A of the first and second hole defining portions 401, 402 are integrally formed with the terminating edges 403A, 404A of the third and fourth hole defining portions 403, 404 so as to define four sides of the opening 40B. The first and second hole defining portions 401, 402 have bottom surfaces and top surfaces that are flush with the top surface of the frame portion 40A. The third and fourth hole defining portions 403, 404 have bottom surfaces that project downward with respect to the bottom surfaces of the first and second hole defining portions 401, 402. The retaining strips 32 of the biasing member 30 are disposed beneath the bottom surfaces of the first and second hole defining portions 401, 402 such that the bottom surfaces of the retaining strips 32 are substantially flush with the bottom surfaces of the third and fourth hole defining portions 403, 404. Thus, the third and fourth hole defining portions 403, 404 prevent lateral movement of the retaining portions 32 and correspondingly secure the biasing member 30 between the base plate 40 and the membrane circuit 20.

The base plate 40 is further formed with opposite flange units 44 which extend inwardly from the frame portion 40A toward two opposite longitudinal edges of the first hole defining portion 401 so as to form two L-shaped slots 44A within the frame portion 40A at the opposite edges of the first hole defining portion 401. The flange units 44 have top surfaces which are generally flush with the top surface of the frame portion 40A, and bottom surfaces which are indented with respect to the bottom surfaces of the third and fourth hole defining portions 403, 404. The flange units 44 further have end portions 44B which are adjacent to the terminating edge 401A of the first hole defining portion 401 and which are formed with a respective downward stop, thereby forming slide recesses in the bottom surfaces of the flange units 44.

The base plate 40 further includes opposite cantilevers 43 which extend inwardly from the frame portion 40A toward two opposite longitudinal edges of the second hole defining portion 402. Each of the cantilevers 43 has a top surface flush with the top surface of the frame portion 40A, and opposite first barb projection 43A at one side thereof. Second barb projections 43B are formed on the opposite longitudinal edges of the second hole defining portion 402 and are aligned spacedly and respectively with the first barb projections 43A. The cantilevers 43 and the second barb projections 43B have bottom surfaces that are generally flush with the bottom surface of the third and fourth hole defining portions 403, 404.

The key cap support 60 includes first and second support levers 61, 62 with upper and lower portions, and curved intermediate portions that are coupled rotatably about a pivot axis 623. The first and second support levers 61, 62 are formed as generally rectangular open frames so as to permit extension of the upper portion 31 of the biasing member 30 therethrough. Two outward pins 612 on the lower portion of the first support lever 61 can be inserted into the slots 44A and slidably retained in the slide recesses of the flange units 44 such that the slots 44A function as slot retainer units. Two outward pins 622 on the lower portion of the second support lever 62 can be forced between aligned ones of the first and second barb projections 43A, 43B such that the aligned first and second barb projections 43A, 43B serve as pivot retainer units. The aligned first and second barb projections 43A, 43B have top edges that form a converging entrance therebetween, and the second barb projections 43B have top edges which are raised with respect to the top surface of the frame portion 40A to facilitate insertion of the outward pins 622 of the second support levers 62. In addition, the cantilevers 43 form clearance 43C with the third and fourth hole defining portions 403, 404 to enhance resiliency of the cantilevers 43, and slits 43D are formed in the frame portion 40A at one side of the second barb projections 43B opposite to the first barb projections 43A to enhance resiliency of the second barb projections 43B.

The key cap 50 has a centrally formed and downwardly extending plunger 53 abutting against the upper portion 31 of the biasing member 30, and a bottom side formed with second slot retainer units 52 for slidably retaining two outward pins 621 on the upper portion of the second support levers 62, and second pivot retainer units 51 for pivotally retaining two outward pins 611 on the upper portion of the first support levers 61. The key cap 50 is biased upwardly by the biasing member 30, and can be depressed against the action of the biasing member 30 so as to compress the latter and enable the biasing member 30 to contact the electrical contact of the membrane circuit 20 in order to produce an electrical signal in a known manner.

Note that the top surfaces of the third and fourth hole defining portions 403, 404 are indented with respect to the top surface of the frame portion 40A such that the indented top surfaces can accommodate the curved intermediate portions of the key cap support 60 during the depression of the key cap 50 relative to the base plate 40, thereby aiding in further reduction of the total thickness in the key switch assembly of this invention.

Another aspect to note is that the frame portion 40A of the base plate 40 is formed with a pair of second downward stops 44C at junctures of the frame portion 40A and the flange units 44 so that the outward pins 612 of the first support lever 61 are prevented from lateral movement with respect to the first and second hole defining portions 401, 402. The stops at the end portions 44B of the flange units 44 and the downward stops 44C have bottom surfaces that are substantially flush with the bottom surfaces of the third and fourth hole defining portions 403, 404.

The followings are some advantages provided by the key switch assembly of this invention:

(I) The unique structures of the base plate and the biasing member enable further reduction in the thickness of the key switch assembly.

(II) It is easy to assemble the key switch assembly of this invention. For example, the outward pins of the key cap support are disposed in alignment with the pivot units and the slot units of the base plate and the key cap, after which the key cap can be depressed downward such that the outward pins of the key cap support are disposed in the pivot and slot retainer units of the base plate and the key cap. The assembly is thus considerably easy as compared to the assembly method for the key switch assembly of U.S. Pat. No. 5,278,374.

(III) Because the retaining strips of the biasing member do not extend between the key cap support and the membrane circuit, the outward pins of the key cap support are in direct sliding contact with the membrane circuit. As such, the sliding and pivoting actions experience little friction and provide a good operational feeling to the user.

With this invention thus explained, it is apparent that numerous modifications and variations can be made without departing from the scope and spirit of this invention. It is therefore intended that this invention be limited only as indicated in the appended claims.

I claim:

1. A key switch assembly for a computer keyboard, said key switch assembly comprising:

a base board;

a membrane circuit disposed on said base board and having an electrical contact;

an upright biasing member supported on said membrane circuit;

a base plate disposed on said membrane circuit and formed with an opening to permit extension of said biasing member therethrough, said opening having first and second sides, said base plate being further formed with a first slot retainer unit adjacent to said first side of said opening, and a first pivot retainer unit adjacent to said second side of said opening;

a scissors-type key cap support including first and second support levers with upper and lower portions, and intermediate portions that are coupled rotatably about a pivot axis, said lower portion of said first support lever being slidably retained in said first slot retainer unit of said base plate, said lower portion of said second support lever being pivotally retained in said first pivot retainer unit of said base plate; and a key cap having a bottom side formed with a second slot retainer unit for slidably retaining said upper portion of said second support lever, and a second pivot retainer unit for pivotally retaining said upper portion of said first support lever, said key cap being biased upwardly by said biasing member and being depressible to compress said biasing member and enable said biasing member to contact said electrical contact and enable said membrane circuit to produce an electrical signal;

said lower portion of said first support lever being formed with opposite first outward pins, said lower portion of said second support lever being formed with opposite second outward pins;

said biasing member having a lower portion formed with a pair of outwardly extending retaining strips, each of said retaining strips having a bottom surface;

said base plate including a hollow rectangular key confining frame portion with a top surface, aligned first and second hole defining portions extending inwardly from said frame portion and having terminating edges that define said first and second sides of said opening, said first and second hole defining portions having bottom surfaces and top surfaces that are substantially flush with said top surface of said frame portion, a third hole defining portion extending inwardly from said frame portion and transverse to said first and second hole defining portions, said third hole defining portion having a bottom surface which projects with respect to said bottom surfaces of said first and second hole defining portions, said retaining strips of said biasing member being disposed beneath said bottom surfaces of said first and second hole defining portions such that said bottom surfaces of said retaining strips are substantially flush with said bottom surface of said third hole defining portion and such that said retaining strips are prevented from lateral movement by said third hole defining portion, thereby securing said biasing member between said base plate and said membrane circuit, opposite flange units extending inwardly from said frame portion toward a respective one of two opposite longitudinal edges of said first hole defining portion so as to form two L-shaped slots within said frame portion at said opposite longitudinal edges of said first hole defining portion, said L-shaped slots constituting said first slot retainer unit, said flange units having top surfaces which are substantially flush with said top surface of said frame portion, and bottom surfaces which are indented with respect to said bottom surface of said third hole defining portion, said flange units having end portions adjacent to said terminating edge of said first hole defining portion and formed with a respective downward first stop, thereby forming slide recesses in said bottom surfaces of said flange units, said first outward pins of said first support levers being inserted through said L-shaped slots and being slidably retained in said slide recesses, opposite cantilevers extending inwardly from said frame portion toward a respective one of two opposite longitudinal edges of said second hole defining portion, said cantilevers respectively having one side formed with a first bard projection and a top surface substantially flush with said top surface of said frame portion, and opposite second barb projections formed on said opposite longitudinal edges of said second hole defining portion and aligned spacedly and respectively with said first barb projections, said first and second barb projections constituting said first pivot retainer unit, said second outward pins of said second support lever being forced between aligned ones of said first and second barb projections for pivotal retention thereat.

2. The key switch assembly as defined in claim 1, wherein said first outward pins are in direct sliding contact with said membrane circuit.

3. The key switch assembly as defined in claim 1, wherein said frame portion is further formed with a pair of second downward stops at junctures of said frame portion and said flange unit to limit lateral movement of said first outward pins.

4. The key switch assembly as defined in claim 3, wherein each of said first and second stops has a bottom surface substantially flush with said bottom surface of said third hole defining portion.

5. The key switch assembly as defined in claim 1, wherein said cantilevers and said second barb projections have bottom surfaces that are substantially flush with said bottom surface of said third hole defining portion.

6. The key switch assembly as defined in claim 1, wherein said second barb projections have top edges which are raised with respect to said top surface of said frame portion to facilitate insertion of said second outward pins between the aligned ones of said first and second barb projections.

7. The key switch assembly as defined in claim 1, wherein the aligned ones of said first and second barb projections have top edges that form a converging entrance therebetween.

8. The key switch assembly as defined in claim 1, wherein said third hole defining portion further has a top surface which is indented with respect to said top surface of said frame portion.

9. The key switch assembly as defined in claim 1, wherein said third hole defining portion has a terminating edge that confines a third side of said opening and that is connected to said first and second hole defining portions.

10. The key switch assembly as defined in claim 1, wherein one of said cantilevers adjacent to said third hole defining portion forms a clearance therewith to enhance resiliency of said one of said cantilevers.

11. The key switch assembly as defined in claim 1, wherein said frame portion is formed with a pair of slits at one side of said second barb projections opposite to said first barb projection to enhance resiliency of said second barb projection.

12. The key switch assembly as defined in claim 1, wherein said first and second support levers are formed as generally rectangular open frames.

13. A key switch assembly for a computer keyboard, said key switch assembly comprising:

a base board;

a membrane circuit disposed on said base board and having an electrical contact;

an upright biasing member supported on said membrane circuit;

a base plate disposed on said membrane circuit and formed with an opening to permit extension of said biasing member therethrough, said opening having opposite first and second sides, said base plate being further formed with a first slot retainer unit adjacent to said first side of said opening, and a first pivot retainer unit adjacent to said second side of said opening;

a scissors-type key cap support including first and second support levers with upper and lower portions, and intermediate portions that are coupled rotatably about a pivot axis, said lower portion of said first support lever being slidably retained in said first slot retainer unit of said base plate, said lower portion of said second support lever being pivotally retained in said first pivot retainer unit of said base plate; and a key cap having a bottom side formed with a second slot retainer unit for slidably retaining said upper portion of said second support lever, and a second pivot retainer unit for pivotally retaining said upper portion of said first support lever, said key cap being biased upwardly by said biasing member and being depressible to compress said biasing member and enable said biasing member to contact said electrical contact and enable said membrane circuit to produce an electrical signal;

said biasing member having a lower portion formed with a pair of outwardly extending retaining strips, each of said retaining strips having a bottom surface;

said base plate including a hollow rectangular key confining frame portion, aligned first and second hole defining portions extending inwardly from said frame portion and having terminating edges that define said first and second sides of said opening, said first and second hole defining portions having bottom surfaces, and a third hole defining portion extending inwardly from said frame portion and transverse to said first and second hole defining portions, said third hole defining portion having a bottom surface which projects with respect to said bottom surfaces of said first and second hole defining portions, said retaining strips of said biasing member being disposed beneath said bottom surfaces of said first and second hole defining portions such that said bottom surfaces of said retaining strips are substantially flush with said bottom surface of said third hole defining portion and such that said retaining strips are prevented from lateral movement by said third hole defining portion, thereby securing said biasing member between said base plate and said membrane circuit.

14. A key switch assembly for a computer keyboard, said key switch assembly comprising:

a base board;

a membrane circuit disposed on said base board and having an electrical contact;

an upright biasing member supported on said membrane circuit;

a base plate disposed on said membrane circuit and formed with an opening to permit extension of said biasing member therethrough, said opening having opposite first and second sides, said base plate being further formed with a first slot retainer unit adjacent to said first side of said opening, and a first pivot retainer unit adjacent to said second side of said opening;

a scissors-type key cap support including first and second support levers with upper and lower portions, and intermediate portions that are coupled rotatably about a pivot axis, said lower portion of said first support lever being slidably retained in said first slot retainer unit of said base plate, said lower portion of said second support lever being pivotally retained in said first pivot retainer unit of said base plate; and a key cap having a bottom side formed with a second slot retainer unit for slidably retaining said upper portion of said second support lever, and a second pivot retainer unit for pivotally retaining said upper portion of said first support lever, said key cap being biased upwardly by said biasing member and being depressible to compress said biasing member and enable said biasing member to contact said electrical contact and enable said membrane circuit to produce an electrical signal;

said lower portion of said first support lever being formed with opposite first outward pins, said lower portion of said second support lever being formed with opposite second outward pins;

said base plate including a hollow rectangular key confining frame portion with a top surface, aligned first and second hole defining portions extending inwardly from said frame portion and having terminating edges that confine said first and second sides of said opening, said first and second hole defining portions having top surfaces that are substantially flush with said top surface of said frame portion, a third hole defining portion extending inwardly from said frame portion and transverse to said first and second hole defining portions, said third hole defining portion having a bottom surface, opposite flange units extending inwardly from said frame portion toward a respective one of two opposite longitudinal edges of said first hole defining portion so as to form two L-shaped slots within said frame portion at said opposite longitudinal edges of said first hole defining portion, said L-shaped slots constituting said first slot retainer unit, said flange units having top surfaces which are substantially flush with said top surface of said frame portion, and bottom surfaces which are indented with respect to said bottom surface of said third hole defining portion, said flange units having end portions adjacent to said terminating edge of said first hole defining portion and formed with a respective downward first stop, thereby forming slide recesses in said bottom surfaces of said flange units, said first outward pins of said first support levers being inserted through said first slots and being slidably retained in said slide recesses, opposite cantilevers extending inwardly from said frame portion toward a respective one of two opposite longitudinal edges of said second hole defining portion, each of said cantilevers having one side formed with a first barb projection and a top surface substantially flush with said top surface of said frame portion, and opposite second barb projections formed on said opposite longitudinal edges of said second hole defining portion and aligned spacedly and respectively with said first barb projections, said first and second barb projections constituting said first pivot retainer unit, said second outward pins of said second support lever being forced between aligned ones of said first and second barb projections for pivotal retention thereat.

* * * * *

UNITED STATES PATENT AND TRADEMARK OFFICE

CERTIFICATE OF CORRECTION

PATENT NO. : 5,767,468
DATED : June 16, 1998
INVENTOR(S) : Huo-Lu TSAI

It is certified that error appears in the above-identified patent and that said Letters Patent is hereby corrected as shown below:

On the title page, Item [54], the title, is incorrect. It should read:

--KEY SWITCH ASSEMBLY FOR A COMPUTER KEYBOARD--

Signed and Sealed this
Fifth Day of January, 1999

*Attest:*

*Attesting Officer*

*Acting Commissioner of Patents and Trademarks*